United States Patent [19]

Merkh

[11] Patent Number: 4,633,070

[45] Date of Patent: Dec. 30, 1986

[54] INFORMATIONAL DEVICE ADAPTED TO CONVERT BINARY TO DECIMAL NUMERALS

[76] Inventor: Arthur J. Merkh, 1 Driftwood Way, Gibbsboro, N.J. 08026

[21] Appl. No.: 793,249

[22] Filed: Oct. 31, 1985

[51] Int. Cl.[4] ..... G06C 3/00

[52] U.S. Cl. ..... 235/88 M; 235/78 M; 434/189; 434/198

[58] Field of Search ..... 235/78 R, 78 M, 88 M, 235/88 R, 78 G, 78 A, 89 R, 69, 70 R; 434/189, 198

[56] References Cited

U.S. PATENT DOCUMENTS

| | | | |
|---|---|---|---|
| 1,161,381 | 11/1915 | Duffy | 235/88 M |
| 1,662,503 | 3/1928 | Krieger | 434/198 |
| 2,462,338 | 2/1949 | Shimrat | 235/78 A |
| 3,259,312 | 7/1966 | Birkmeyer, Sr. | 235/78 G |
| 3,332,156 | 7/1967 | Reeves | 235/89 R X |
| 3,419,973 | 1/1969 | Manotas et al. | 235/88 M X |
| 3,624,928 | 12/1971 | Felton | 235/88 M X |
| 3,639,733 | 2/1972 | Larson | 235/78 M X |
| 3,732,632 | 5/1973 | Dyer | 235/88 M X |
| 3,903,397 | 9/1975 | Yata et al. | 235/88 R |
| 4,435,640 | 3/1984 | Micheletto | 235/78 M |

*Primary Examiner*—Benjamin R. Fuller
*Attorney, Agent, or Firm*—Robert K. Youtie

[57] ABSTRACT

A stack of sheets, each sheet from the next to lowermost upwardly corresponding to a successive binary place, the lowermost sheet carrying array of decimal numerals, a pivot connecting the sheets for relative rotation, and a window in each sheet above the lowermost configured to expose in one position of sheet movement the decimal corresponding to the binary place of the respective sheet and additional decimal numerals.

12 Claims, 5 Drawing Figures

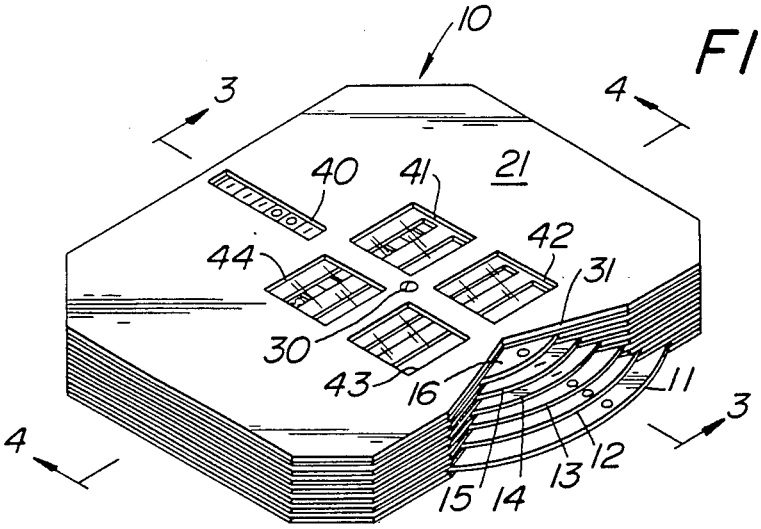
FIG. 1
FIG. 3
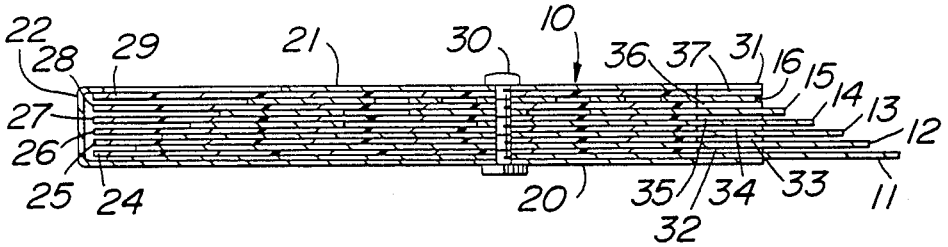
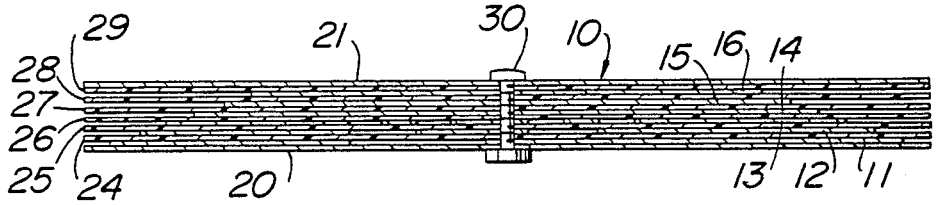
FIG. 4

INFORMATIONAL DEVICE ADAPTED TO CONVERT BINARY TO DECIMAL NUMERALS

BACKGROUND OF THE INVENTION

The instant invention is concerned in a very broad sense with registers or calculators, and more specifically with an informational or educational device including plural concentric discs having openings therethrough and indicia for selective presentation through the openings. While such devices generally are well known, such prior devices are structurally different and functionally incapable of the same result.

The prior art known is that listed below:

| U.S. PAT. NO. | PATENTEE |
|---|---|
| 1,161,381 | DUFFY |
| 1,662,503 | KRIEGER |
| 3,419,973 | MANOTAS ET AL. |
| 3,624,928 | FELTON |
| 3,639,733 | LARSON |
| 3,732,632 | DYER |
| 4,435,640 | MICHELETTO |

While the prior art is structurally similar in a broad sense, the specific orientation and arrangement of cooperating components is entirely new and produces a different and advantageous result.

SUMMARY OF THE INVENTION

It is an important object of the present invention to provide a multiple sheet construction wherein window formations can be arranged in the several sheets, and the sheets moveable, either rotationally or otherwise, to expose a preselected indica corresponding to the sheet positions. Thus, the device of the present invention may be employed in its illustrated manner as a binary to decimal converter, or may be employed otherwise, as a game of "true or false", or other.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view of an informational device constructed in accordance with the present invention and illustrating one operative condition of use.

FIG. 3 is a sectional view taken generally along the line 3—3 of FIG. 1.

FIG. 4 is a sectional view taken generally along the line 4—4 of FIG. 1.

DESCRIPTION OF THE PREFERRED EMBODIMENT

Figure 2A:
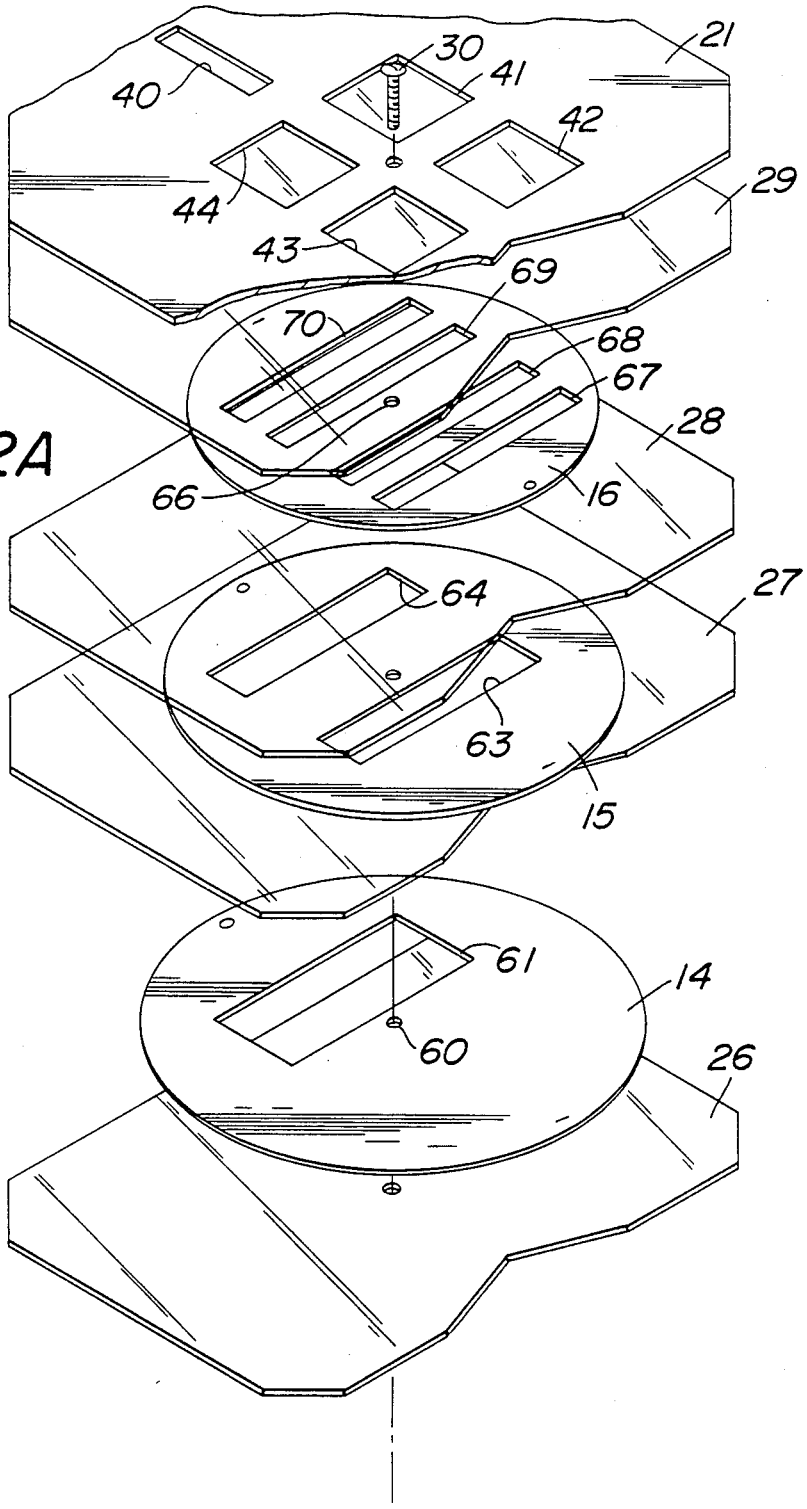
FIGS. 2A and 2B combine to illustrate an exploded perspective view of the device of FIG. 1.

Referring now more particularly to the drawings, and specifically to FIGS. 1, 3 and 4, an informational device of the present invention is there generally designated 10 and includes a plurality of superposed circular sheets or disks 11, 12, 13, 14, 15 and 16. The sheets or disks 11–16 are each of successively less diameter than the adjacent nether sheet, and arranged or stacked concentrically, so that the peripheral margin of each sheet is exposed upwardly beyond the peripheral margin of the next adjacent upper sheet, as seen in FIG. 1.

A lowermost sheet or base 20 is beneath the sheet or disk 11, and advantageously of noncircular configuration, say a generally rectangular outline configuration as shown. An uppermost sheet 21 is located over the upper disk or sheet 16 and may be generally congruent to the base 20 or of other noncircular configuration.

The bottom and top sheets 20 and 21 may, in practice, be advantageously integrally fabricated and connected together by a side piece or hinge portion 22 connecting together one adjacent pair of side edges of the lower and upper sheets. It is appreciated that the disks or sheets 11–16, as well as the bottom and top sheets 20 and 21, and hinge 22 may all be fabricated of relatively thin paper stock or board and that sheet thickness in the drawings is necessarily exaggerated.

Interposed between each adjacent pair of sheets 11–16, and the top sheet 21, may be a relatively smooth, low friction transparent plastic sheet, as at 24, 25, 26, 27, 28 and 29.

The hinge 22 may, in fact, be a fold line or crease hingedly connecting the lower and upper sheets 20 and 21. The several low friction sheets 24–29 may be configured of generally rectangular outline configuration, each having one side edge extending closely along the hinge 22. This effectively prevents rotation of the low friction sheets 24–29, and will appear presently.

A pivot or pin 30 may extend generally centrally through all of the superposed sheets 20, 11, 24, 12, 25, 13, 26, 14, 27, 15, 28, 16, 29 and 21. The pin 30 retains the several components assembled, and mounts the several sheets 11–16 for axial rotation relative to each other and relative to the base 20 and top sheet 21. As noted hereinbefore the low friction leaves or sheets 24–29 are constrained against rotation by suitable means, such as edge engagement with the hinge 22, while faciliting rotation of the several sheets 11–16 relative to each other.

Opposite to the hinge 22, the top piece 21 may be cut away, or indented, as at 31, and similarly the low friction sheets 24, 25, 26, 27, 28 and 29 may be indented, as at 32, 33, 34, 35, 36 and 37, all congruent with each other and the top sheet at 31. This efffectively exposes additional peripheral marginal material of the disks 11–16, with minimal disk extension.

The top sheet 21 is provided with a window formation 40 or elongate aperture extending generally radially of the concentric disks 11–16, adjacent to the hinge 22. In addition, the top sheet 21 is centrally open about the pivot 30, as by four windows or openings 44. The window formation 41–44 may be other than the rectangular arrangement in four quadrants, as shown.

Figure 2B:
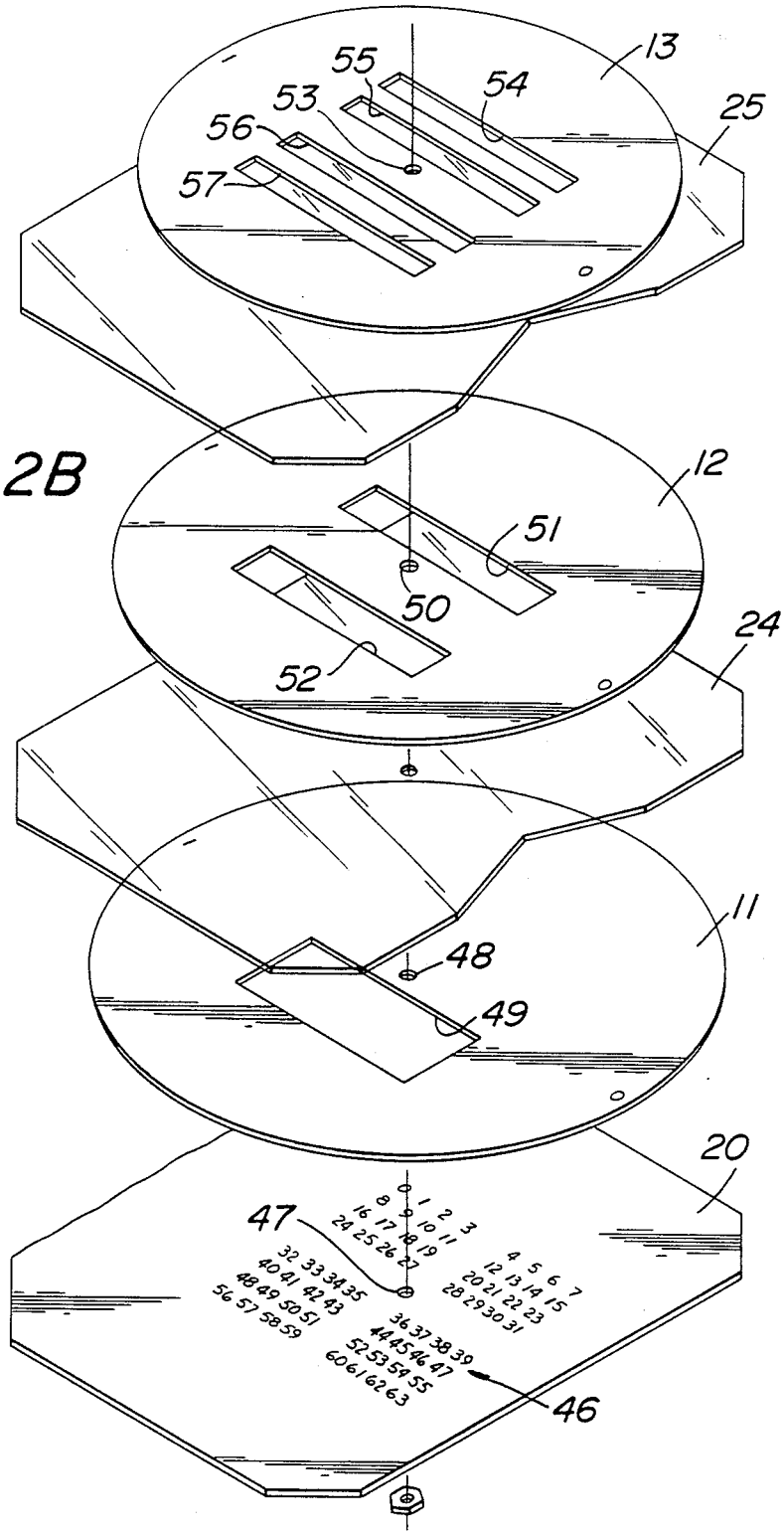

Referring now to the exploded perspective of FIGS. 2A and 2B, the lowermost sheet 20 is seen as carrying on its upper or inner surface an array of indicia, specifically sequentially arranged decimal numerals, in the illustrated embodiment proceeding from "0" to "63". While the overall outline configuration of the array of imprinted indicia is generally rectangular, generally congruent to that of the top wall window formation 41–44, it could be otherwise, if desired, without departing from the spirit and scope of the present invention.

The indicia array on top of sheet 20 is generally designated 46, and is seen as separated into four quadrants about the central pin receiving hole 47.

Directly over the bottom sheet 20 is the lower disk 11 which is provided with a central pin receiving hole 48, and a window formation 49 of generally rectangular outline configuration and extending generally normal to a minimum or minor radius from the central hole 48. The window formation 49 is of a size to expose or present therethrough half of the numerals of numeral array 46. At diametrically opposed locations on the disk 11 are binary digits "0" and "1".

Directly over the disk or sheet 11, as separated therefrom by sheet 24 is sheet 12 having a central pin receiving opening 50 and provided with window formations 51 and 52, being generally rectangular openings on opposite sides of and each extending normal to a minor or minimal radius form the central hole 50. At diametrically opposed locations on the periphery of diskette 12 are also provided markings of binary numbers "0" and "1".

The windows or openings 51 and 52 are generally rectangular, and each sized to present therethrough one-fourth of the decimal numerals of array 46. Thus, a total of one-half the array is presented through the window formations 51 and 52, the particular half being dependent upon whether the disk 12 is in the illustrated position of movement or rotated 180° therefrom.

Superposed above the disk 12 is the disk 13, the sheet 25 being interposed between the disks. A central pivot hole 53 is provided in the disk 13, and a plurality of window formations 54, 55, 56 and 57, all of rectangular configuration and arranged in an overall rectangular configuration, are formed in the sheet. The several windows or openings 54–57 are all arranged to extend normal to a diameter of the disk 13 and are sized and located to expose therethrough an aggregate of one-half of the decimal numerals of array 46. Upon 180° rotation of the disk 13, the other one-half of the decimal numerals will be exposed through the window formations 54–57. At diametrically opposed peripheral marginal locations on the disk 13 are provided binary digits "1" and "0".

The disk or sheet 14 is superposed over the disk 13, with the low friction sheet 26 interposed. The disk 14 is formed with a central pivot hole 60 and a rectangular window formation 61 extending normal to a minor radius of the disk 14. At diametrically opposed locations on the peripheral margin of the disk 14 are binary digits "0" and "1". The window formation 61 is of a single rectangular configuration, sized to expose two quadrants, or one-half the decimal numerals of array 46.

Superposed over the disk 14 is the disk 15, with the sheet 27 interposed therebetween. The disk 15 includes a central pivot hole 62, and a pair of generally parallel, spaced rectangular formations of windows or openings 63 and 64, both arranged generally normal to minimal or minor radii. The window openings 63 and 64 are sized to present therethrough one-half of the numerals of array 46. Also provided on the disk 15 at diametrically opposed peripheral marginal locations are binary digits "0" and "1".

The uppermost disk 16 is superposed over the disk 15, with the low friction sheet 28 interposed therebetween. A central pivot hole 66 is formed in the disk 16, and a plurality of window formations or openings are arranged in parallelism with each other normal to a diameter of the disk. The window formations 67–70 are sized and arranged to expose therethrough one-half of the decimal numerals of the array 46 in one disk position, and to expose or present therethrough the remaining half of the numerals in a disk position rotated 180°.

The disk 16 is also provided at diametrically opposed peripheral locations with binary digits "1" and "0".

As shown in both FIG. 1 and FIG. 2, the disks 11–15 assume a specific position illustrating operation of the device.

In the illustrated disk position there appears through the top wall window 40 the binary number 111001 corresponding to the decimal numeral 57. The decimal numeral 57 appears through the top wall window 44 as an indication of the decimal number equivalent of the set binary number.

That is, the binary number was set by rotating the disks 11–15 to place the required binary number in window 40. As the uppermost disk 16 corresponds to the first binary number place or position, while the next lowermost disk 15 corresponds to the next binary place or position, and so forth. The binary places from right to left, correspond respectively to the decimal numbers 1, 2, 4, 8, 16 and 32. Therefore the binary number set in the window 40 in FIG. 1 is the sum of the numerals 1, 8, 16, and 32, being shown as 57 in the window 44.

The disks may be considered as each corresponding to a respective binary number place, for example the uppermost disk 16 corresponding to the rightmost binary number place. Further, each disk may have a pair of positions, 180° apart, as with either the peripheral binary digit "1" or "0" presented through the window 40. For purposes of terminology, the position with the digit "1" exposed through window 40 may be considered as an indicating or operative position. In this position, each disk has its window formation aligned with and presents therethrough the decimal numeral corresponding to the binary place and additional decimal numerals which may be required in combination with the corresponding decimal numeral. For example, in the operative or indicating position of disk 16 with its binary numeral "1" presented through window 40, the windows 67, 68, 69 and 70 will be aligned with and present therethrough the decimal numeral corresponding to the binary place, which is decimal numeral 1, as well as additional decimal numerals, all of which can result by the addition of the corresponding numeral 1 with other decimal equivalents of binary places within the limits of the binary places of the device. From observation of FIG. 2 herein, it will be seen that the window 70 of disk 16 exposes the column of decimal numerals "1, 9, 17, 25, 33, 41, 49 and 57". Window 69 exposes therethrough the column of decimal numerals "3, 11, 19, 27, 35, 43, 51 and 59"; while window 68 exposes therethrough the column of decimal numerals "5, 13, 21, 29, 37, 45, 53 and 61"; and window 67 exposes the column of decimal numerals "7, 15, 23, 31, 39, 47, 55 and 63".

These exposed numerals, except numeral "1" are all numerals which can result by addition of "1" to the decimal equivalents of the binary places of this device.

The foregoing description of the window formation 67–70 of disk 16 is also true of the window formations of the remaining disks 15, 14, 13, 12 and 11.

Conversely, it follows that the configuration of windows of the several disks 11–16 is such as to mask all those decimal numerals which cannot result by addition of the decimal numeral corresponding to the respective disk to other decimal equivalent numbers.

Each disk in its non-indicating position 180° from its indicating position will mask or conceal all of the decimal numerals exposed in its indicating position, and expose or present all of the decimal numerals masked in its indicating position.

Thus, the plural disks and their window formations cooperate to present only a single decimal numeral exposed through the front wall window formation 41–44. That single exposed decimal numeral which is common to all of the disks in the indicating position.

Although the present invention has been described in some detail by way of illustration and example for purposes of clarity of understanding, it is understood that certain changes and modifications may be made within the spirit of the invention.

What is claimed is:

1. A binary to decimal converter comprising a base, an array of decimal numerals imprinted on said base, a stack of sheets on said base overlying said array, mounting means mounting said sheets for movement relative to each other and said base, and window formations in said sheets configured for alignment with decimal numerals of said array, said sheets each corresponding to a respective binary place, and said window formation of each sheet being configured for alignment in one position of movement with only the corresponding decimal numerals of each binary place in combination with said corresponding decimal numeral.

2. A binary to decimal converter according to claim 1, said array of decimal numerals being generally rectangular in outline configuration and with respective decimal numerals in ranks and files, and said window formations being generally rectangular for said alignment.

3. A binary to decimal converter according to claim 2, said window formation of each sheet being additionally configured for alignment in another position of movement with the remainder of said decimal numerals, to obscure said corresponding and additional decimal numerals when the respective sheet is in another position of movement.

4. A binary to decimal converter according to claim 3, said rectangular array of decimal numerals being arranged in quadrants, and said mounting means comprising a pivot centrally of said quadrants.

5. A binary to decimal converter according to claim 4, said window formations each extending normal to a radius from said pivot and spaced from said pivot for alignment with and occlusion of said corresponding and additional decimal numerals.

6. A binary to decimal converter according to claim 1, said additional decimal numerals including all numbers which can result by addition of said corresponding decimal numeral with other decimal equivalents of binary places within the limits of the converter.

7. A binary to decimal converter according to claim 1, the sheets of said stack being generally circular and of successively reduced diameter one above the other and a cover connected to said base and overlying said stack of sheets.

8. A binary to decimal converter according to claim 7, said sheets each having the binary digits "0" and "1" at diametrically spaced locations on its peripheral margin, and a window in said cover for presentation therethrough of a binary number constituted of said digits selected by the positions of said sheets.

9. A binary to decimal converter according to claim 7, in combination with a plurality of relatively smooth leaves interposed between adjacent sheets and held against rotation, to facilitate rotation of a selected sheet without rotation of adjacent sheets.

10. A binary to decimal converter according to claim 7, said array of decimal numerals being generally rectangular in outline configuration and with successive respective decimal numerals in ranks and files, and said window formations being generally rectangular for said alignment with selected ranks and files of decimal numerals.

11. A binary to decimal converter according to claim 10, said mounting means comprising a pivot centrally of said array of decimal numerals for relative rotation of said stack of sheets, and said window formation of each sheet being additionally configured for alignment in a diametrically opposed position of movement with the remainder of said decimal numerals, to obscure said corresponding and additional decimal numerals when the respective sheet is in said opposite position of movement.

12. A binary to decimal converter according to claim 11, said rectangular window formations each extending normal to a radius from said pivot and spaced from said pivot for alignment with and occlusion of said corresponding and additional decimal numerals.

* * * * *